US008565044B1

(12) United States Patent
Spiker et al.

(10) Patent No.: US 8,565,044 B1
(45) Date of Patent: Oct. 22, 2013

(54) TIMER FOR RESERVING OCCUPANCY OF A COMMUNAL ITEM AND METHOD OF USE

(76) Inventors: Erin C. Spiker, Dublin, OH (US); Molly K. Ritchey, Zanesville, OH (US)

( * ) Notice: Subject to any disclaimer, the term of this patent is extended or adjusted under 35 U.S.C. 154(b) by 372 days.

(21) Appl. No.: 13/066,409

(22) Filed: Apr. 14, 2011

Related U.S. Application Data

(60) Provisional application No. 61/344,068, filed on May 17, 2010.

(51) Int. Cl.
*G04F 1/00* (2006.01)

(52) U.S. Cl.
USPC ..... 368/108; 368/89; 368/90; 368/107

(58) Field of Classification Search
USPC ..... 368/89, 90, 97, 98, 107, 108, 109, 244
See application file for complete search history.

(56) References Cited

U.S. PATENT DOCUMENTS

| | | | | |
|---|---|---|---|---|
| 3,648,454 | A * | 3/1972 | Morrison | 368/2 |
| 4,763,898 | A * | 8/1988 | Hemmann | 273/153 R |
| 5,058,086 | A * | 10/1991 | Barlow | 368/98 |
| 5,095,468 | A * | 3/1992 | Sato | 368/72 |
| 5,568,452 | A * | 10/1996 | Kronenberg | 368/262 |
| 5,903,520 | A * | 5/1999 | Dee et al. | 368/90 |
| 5,966,345 | A * | 10/1999 | Dee et al. | 368/90 |
| 6,102,285 | A * | 8/2000 | Elias | 235/377 |
| 6,122,227 | A * | 9/2000 | Kuo | 368/109 |
| 6,977,341 | B1 * | 12/2005 | Gustaveson, II | 174/66 |
| 7,484,882 | B2 | 2/2009 | Bhavnani | |

* cited by examiner

*Primary Examiner* — Renee Luebke
*Assistant Examiner* — Jason Collins
(74) *Attorney, Agent, or Firm* — Ted Masters

(57) ABSTRACT

A timer for reserving occupancy of a communal item has a communal item available indicator which is positionable to (1) a retracted position when the communal item is in use, and (2) to an extended position when the communal item is available for use. The timer also includes a service request indicator which indicates when as service is required. The timer can also include a reset control which can only be activated by a person other than the user of the communal item.

28 Claims, 7 Drawing Sheets

20
28
COMMUNAL ITEM AVAILABLE INDICATOR
36
DISPLAY
25
REMAINING TIME INDICATOR
30
CONTROL MECHANISM
44
ENABLING TRANSACTION
22
TIMING MECHANISM (PROCESSOR)
50
POWER SUPPLY
24
TIMER CONTROL
26
BUTTONS

TIMER FOR RESERVING OCCUPANCY OF A COMMUNAL ITEM AND METHOD OF USE

CROSS REFERENCE TO RELATED APPLICATION

This application claims the filing benefit under 35 U.S.C. §119(e) of U.S. Provisional Application No. 61/344,068, filed May 17, 2010, which is hereby incorporated by reference.

TECHNICAL FIELD

The present invention pertains generally to timing devices, and more particularly to a timer and method which is used to reserve occupancy of a communal item.

BACKGROUND OF THE INVENTION

In certain venues communal items are made available for the use of multiple users. For example lounge chairs are typically provided for the guests of cruise ships and hotel swimming pool areas. The lounge chairs are occupied on a first-come-first-serve basis, and remain occupied until the current user elects to leave the area. If however there are an insufficient number of lounge chairs to accommodate all guests, then some guests must wait for a lounge chair to become available. The wait can be frustrating since there is usually no provision for sharing the communal item by limiting the period of use. Also, confusion can arise as to whether the communal item is in fact in use. That is, if the communal item is physically unoccupied but some personal articles are disposed in the area, it can be unclear to a desirous user if the communal item is now available.

In view of the above, it would be useful to provide a means by which the time of occupancy of a communal item can be regulated, and further which provides a positive indication as to the availability of the communal item.

BRIEF SUMMARY OF THE INVENTION

The present invention is directed to timer and method for reserving occupancy of a communal item. The timer is connected or placed adjacent to the communal item and set to a time period of reserved occupancy. The timer regulates occupancy of the communal item, prevents monopolization, and provides a positive indication of the occupancy status of the communal item. The timer and method ensure that the use of the communal item is optimized by notifying waiting users when the communal item is available. The timer also allows reservation without the risk of using personal items (clothing, etc.) as a place holder on or near the communal item. Further, the timer and method help instill a sense of fairness among potential users, thereby promoting good will for the venue.

In accordance with an embodiment, a timer for reserving occupancy of a communal item includes a timing mechanism which is settable to run for a period of time, and a timer control which is used to set the period of time. The timer further includes a communal item available indicator which is positionable to (1) a retracted (reserved) position during the period of time, and (2) to an extended (available) position after the period of time has expired. A control mechanism causes the communal item available indicator to move to the extended position when the period of time has expired. The timer further includes a service request indicator which is postionable to (1) a retracted position, and (2) an extended position which indicates that a service is requested. The timer is connectable to the communal item.

In accordance with another embodiment, the timer includes a display which is capable of displaying a first message during the period of time, and a second message after the period of time has expired.

In accordance with another embodiment, the first message is a reserved message, and the second message is an available message.

In accordance with another embodiment, the communal item available indicator is biased to the extended position. The control mechanism holds the communal item available indicator in the retracted position during the period of time, and releases the communal item available indicator when the period of time has expired so that the communal item available indicator is urged to the extended position.

In accordance with another embodiment, once the timing mechanism has begun to run, the timing mechanism is not resettable to a lower remaining time.

In accordance with another embodiment, the timer control including a reset control which interrupts the running of the timing mechanism and allows resetting of the timing mechanism to a lower remaining time. The reset control requires a key to effect the resetting to a lower remaining time.

In accordance with another embodiment, once the timing mechanism has begun to run, the timing mechanism is not resettable to a higher remaining time.

In accordance with another embodiment, the timer control includes a reset control which interrupts the running of the timing mechanism and allows resetting of the timing mechanism to a higher remaining time. The reset control requires a key to effect the resetting to a higher remaining time.

In accordance with another embodiment, the timer includes a plurality of service request indicators.

Other possible embodiments, in addition to the possible embodiments enumerated above, will become apparent from the following detailed description, taken in conjunction with the accompanying drawings, which illustrate, by way of example, the principles of the timer and method of use.

DETAILED DESCRIPTION OF THE INVENTION

Figure 1:
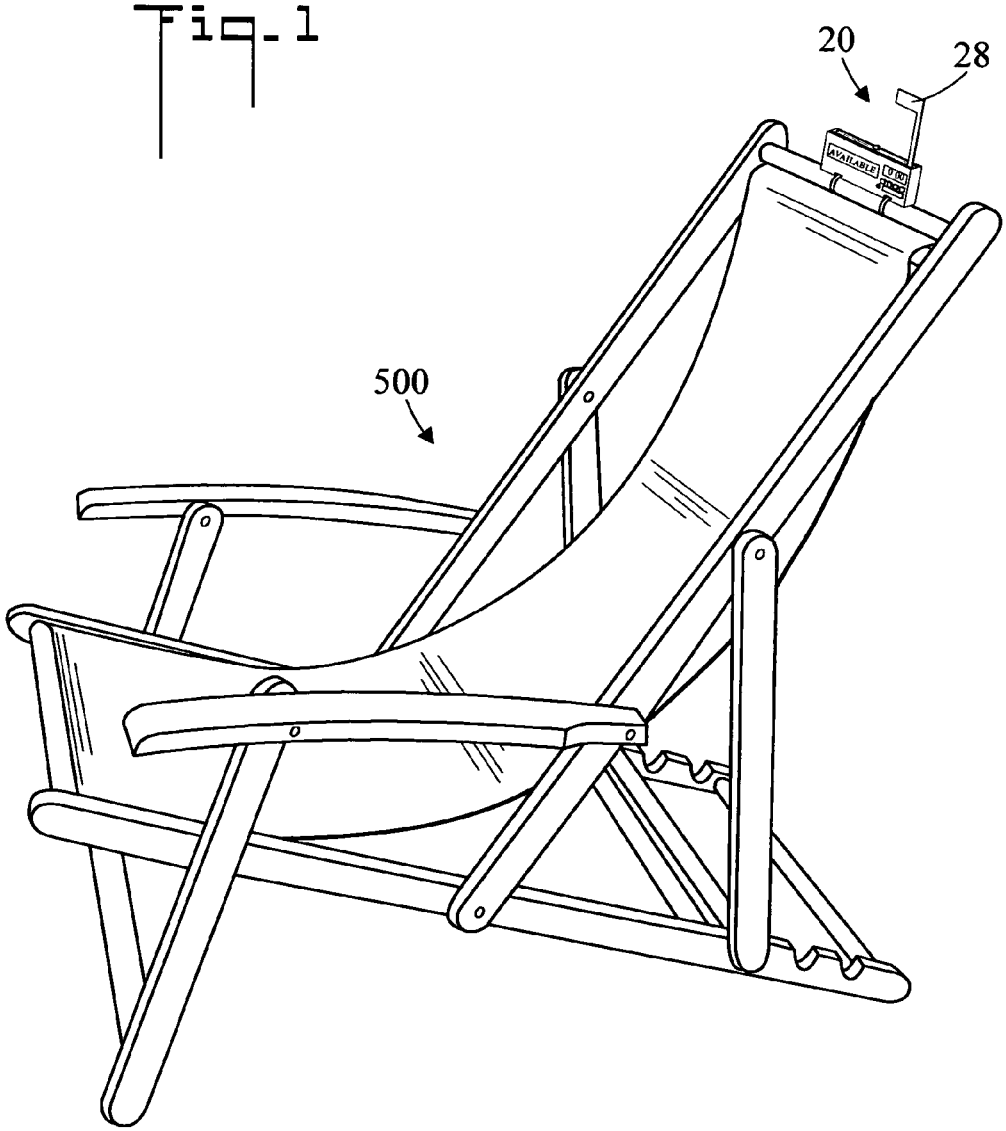
FIG. 1 is a reduced perspective view of a timer for reserving occupancy of a communal item with the timer connected to a communal item.
Figure 2:
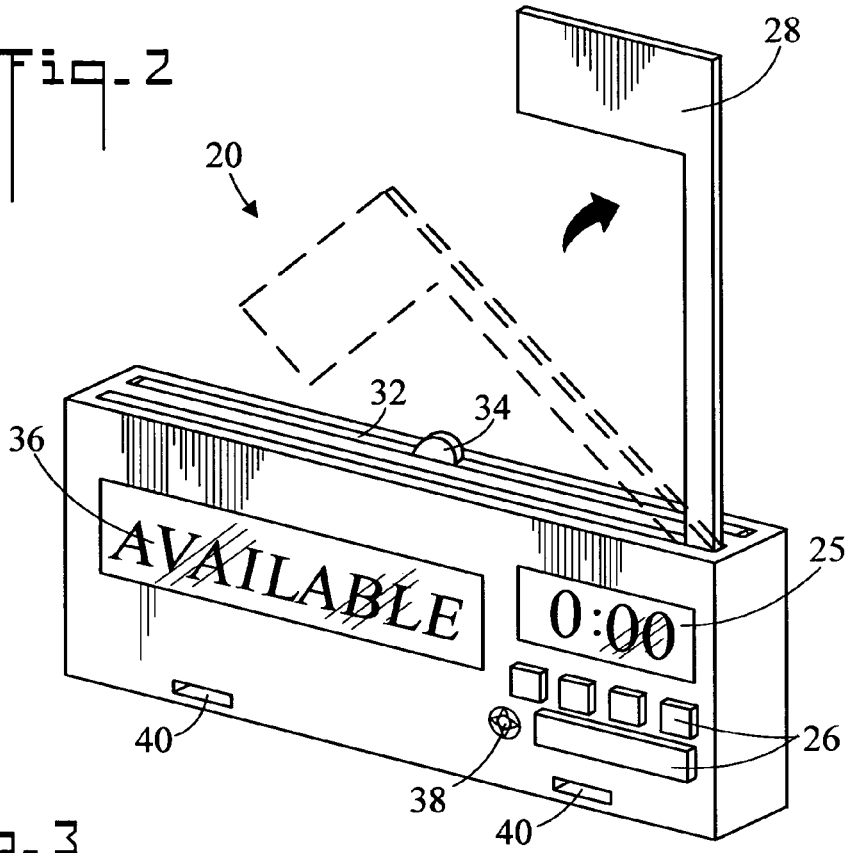
FIG. 2 is a perspective view of the timer with a communal item available indicator in an extended position.
Figure 3:
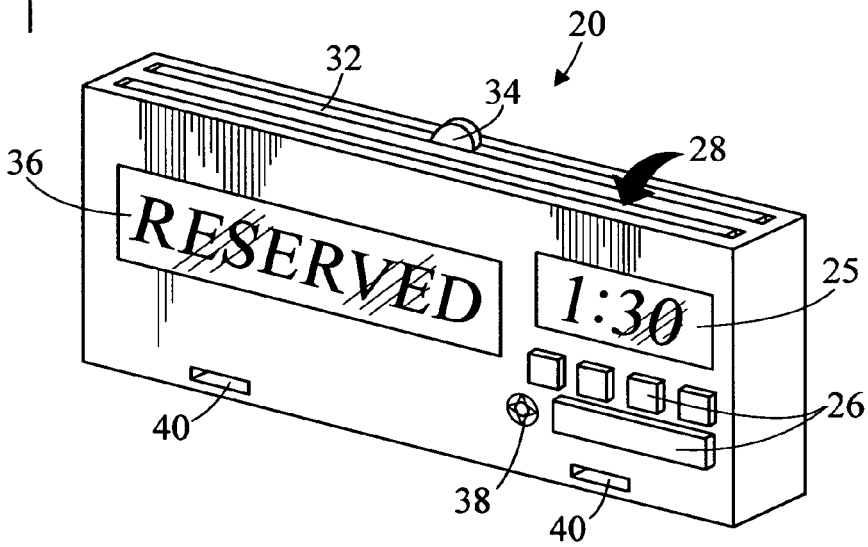
FIG. 3 is a perspective view of the timer with the communal item available indicator in a retracted position.
Figure 4:
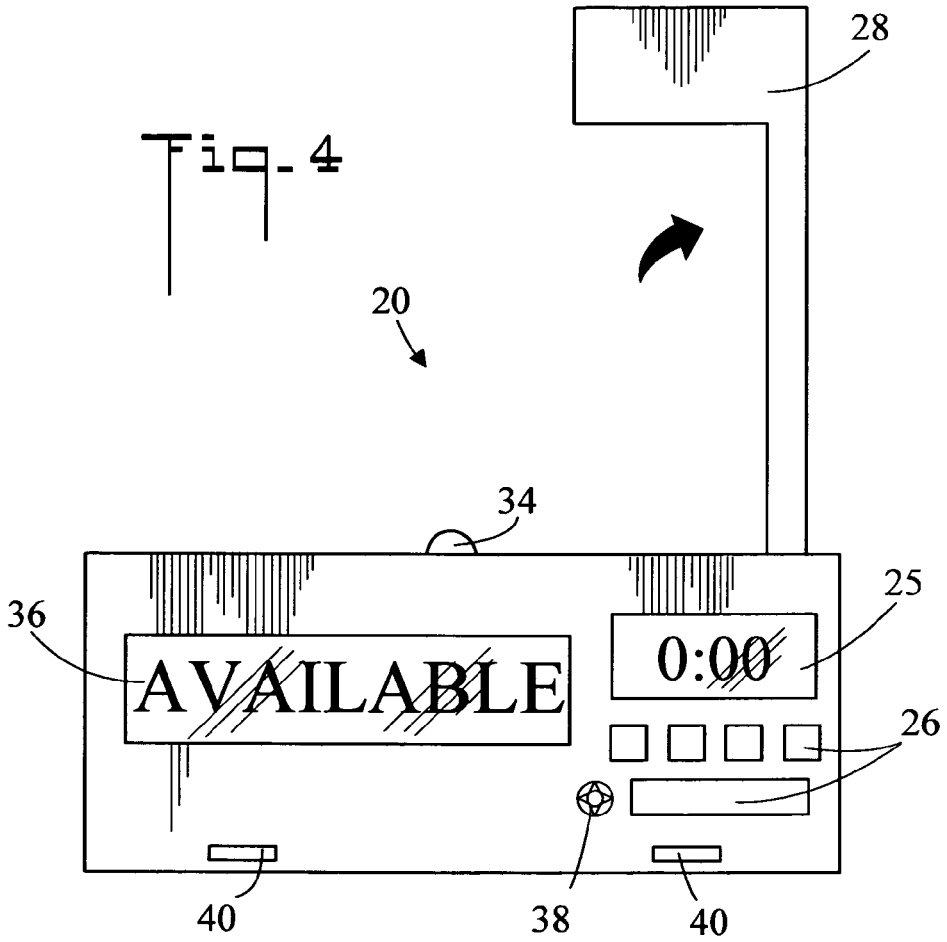
FIG. 4 is front elevation view of the timer with the communal item available indicator in the extended position.
Figure 5:
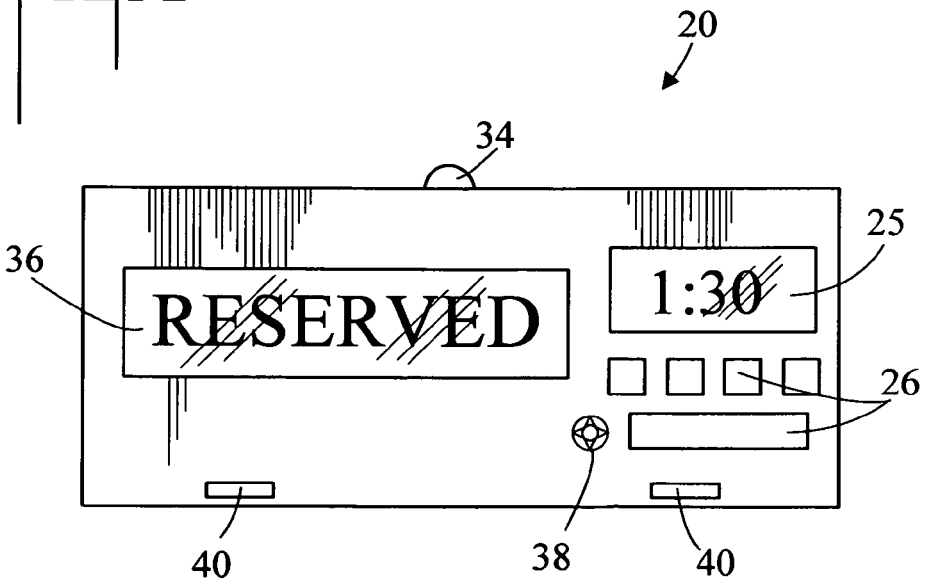
FIG. 5 is a front elevation view of the timer with the communal item available indicator in the retracted position.

Referring initially to FIG. 1, there is illustrated a reduced perspective view of a timer 20 for reserving occupancy of a communal item 500 with timer 20 connected to communal item 500. FIGS. 2-3 are perspective views of timer 20, and FIGS. 4-5 are front elevation views of timer 20. Timer 20 is removably connectable to communal item 500, and is used to regulate how long a particular user can use communal item 500. As used herein the term "communal item" embraces any item which is provided for use by multiple users, and which is used by a particular user for a period of time.

Figure 10:
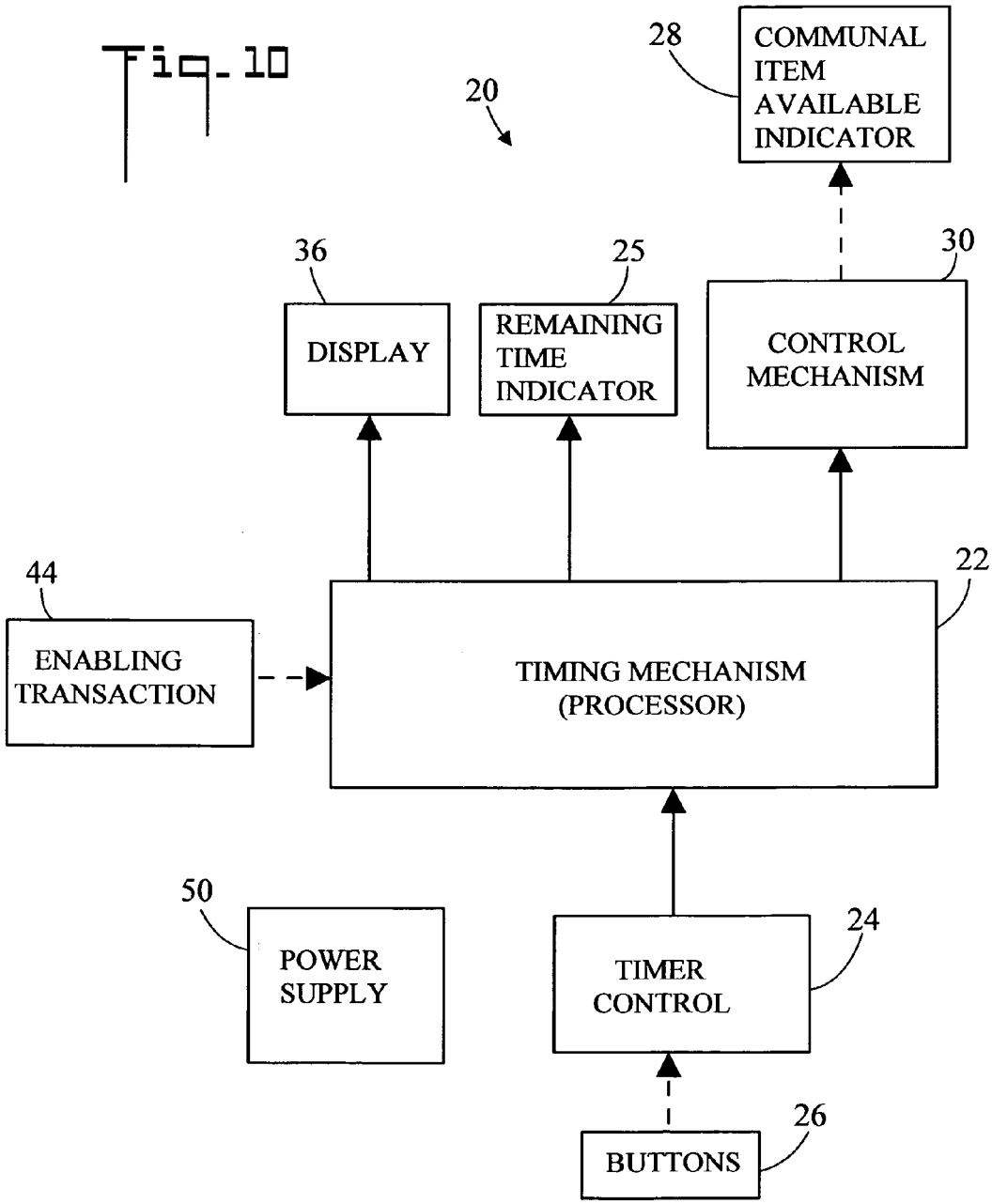
FIG. 10 is block diagram of the timer.

Also referring to FIG. 10, timer 20 includes a timing mechanism 22 which is settable to run for a period of time, and a timer control 24 which is used to set the period of time. In the shown embodiment, timing mechanism 22 includes a digital processor, and timer control 24 includes a plurality of control buttons 26 which are disposed on the face of timer 20. Control buttons 26 are used to set timing mechanism 22 to run for a desired period of time, and can be used to perform other timing-related actions (e.g. on/off, stop, reset, etc.). In one embodiment the setting of timer mechanism 22 is limited to a maximum period of time (e.g. 15 minutes, one hour, etc.). This ensures that communal item 500 will not be monopolized and will be available for another user. In the shown embodiment, a remaining time indicator 25 indicates the amount of time remaining before the set time period expires (i.e. remaining time indicator 25 counts down from the remaining time to zero).

Timer 20 further includes a communal item available indicator 28 which is positionable to (1) a retracted position (physically within the housing of timer 20) during the period of time, and (2) to an upwardly extended position after the period of time has expired. In the shown embodiment, communal item available indicator 28 includes a flag on a pole which pivots between the retracted position of FIG. 3, and in the extended position of FIGS. 2 and 4. Communal item available indicator 28 is biased (such as through spring loading) to the extended position.

Referring also to FIG. 10, a control mechanism 30 such as a latch holds communal item available indicator 28 in the retracted position during the period of time (i.e. during the time communal item 500 is reserved). When the set period of time has expired, control mechanism 30 causes communal item available indicator 28 to move to the extended position. That is, control mechanism 30 releases communal item available indicator 28 when the period of time has expired so that communal item available indicator 28 is urged by spring loading to the extended position.

Figure 7:
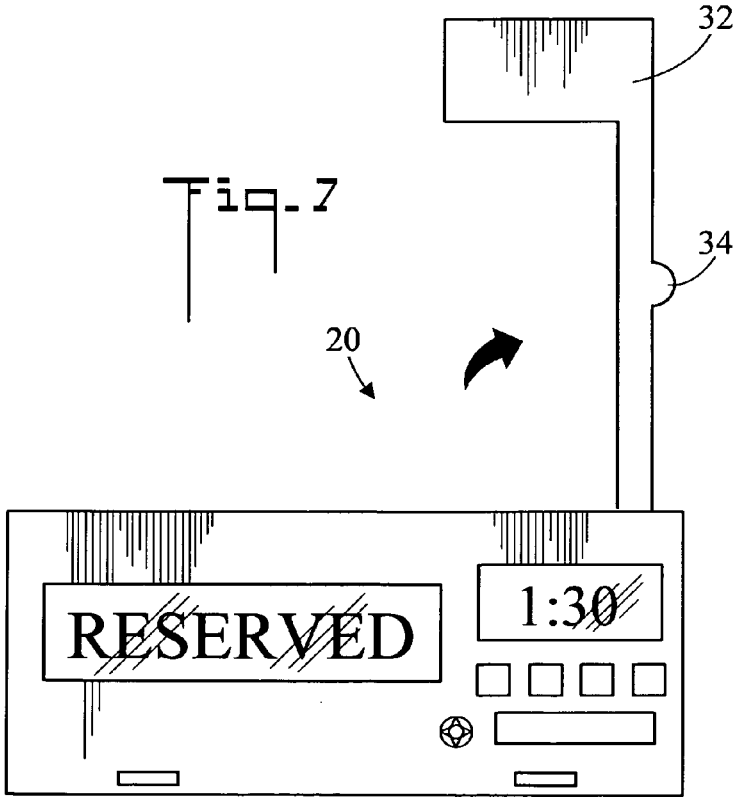
FIG. 7 is a front elevation view of the timer with a service request indicator in an extended position.

Referring also to FIG. 7, timer 20 further includes a service request indicator 32 which is positionable to (1) a retracted position, and (2) an extended position. The extended position indicates that a service such as food, drink, or other amenity is requested. In the shown embodiment service request indicator 32 is flag which is manually positioned by the user, and has a tab 34 which facilitates gripping.

It may be appreciated that communal item available indicator 28 and service request indicator 32 could have shapes or forms other than that of a flag and pole. Also, the communal item available indicator 28 and service request indicator 32 could be colored and/or display indicia. And, timer 20 could produce an audible sound when time has expired to provide a second indicator (in addition to visible the flag) for notifying when time has expired.

Timer 20 further includes a display 36 which is capable of displaying a first message during the period of time, and a second message after the period of time has expired. As such, display 36 works in conjunction with communal item available indicator 28 to convey the occupancy status of the communal item. In the shown embodiment, the first message is a reserved message (RESERVED), and the second message is an available message (AVAILABLE). Display 36 can be a LCD display or other similar electronic display. As used herein the term "RESERVED" and "AVAILABLE" are intended to embrace any similar terminology which means that communal item 500 is in use or not in use respectively (e.g. occupied, in use, free, open, not in use, etc.).

In another embodiment, display 36 is capable of showing a message in grayscale or different colors, and may flash to produce an enhanced visual impact. Also, display 36 could display other messages or phrases not related to the reserved or available status of communal item 500.

In the shown embodiment, the various components of timer 20 are disposed in/on a housing which is both weather and shock resistant. Moreover, timer 20 can be manufactured in a variety of sizes, shapes, colors, and designs depending on the intended use. Attachment of the housing to communal item 500 can be effected by numerous means as is discussed below under FIG. 6.

In an embodiment, once timing mechanism 22 has begun to run it is not resettable to a lower remaining time. This feature prevents a person who has not reserved communal item 500 from resetting timing mechanism 22 in order to expedite the availability of the communal item 500. For example, if a reserving user briefly steps away from a reserved communal item 500, another person could not seize that opportunity to lower the remaining time. In another embodiment, timer control 24 includes a reset control which interrupts the running of timing mechanism 22 and allows resetting of timing mechanism 22 to a lower remaining time. However, the reset control requires a key to effect resetting to a lower remaining time. For example, this feature is useful if the reserving user decides to abandon communal item 500 before the set time period has expired. In this case, the time could be reset to zero so that the next user would not have to start occupancy with a low remaining time. In an embodiment the key is a specially designed mechanical key which fits a specially designed receptacle 38 on the face of timer 20 (refer to FIGS. 2-5). Alternatively, the key could comprise a code which is entered using control buttons 26 (e.g. a specified sequence of button activation which enables the reset feature). The key would typically be in the possession of a person other than the user (such as a pool or gym attendant) who is authorized to perform the resetting, and when requested can do so for any communal item 500.

In another embodiment, once timing mechanism 22 has begun to run it is not resettable to a higher remaining time. This feature prevents a user from resetting timing mechanism 22 in order to prolong occupancy of communal item 500. In another embodiment, timer control 24 includes a reset control which interrupts the running of timing mechanism 22 and allows resetting of timing mechanism 22 to a higher remaining time, however as in the case of the lower time reset discussed above, the reset requires a key to effect the resetting to a higher remaining time. This feature is useful when there is no one currently waiting to use communal item 500, and the present user desires to extend the reserved time.

Figure 6:
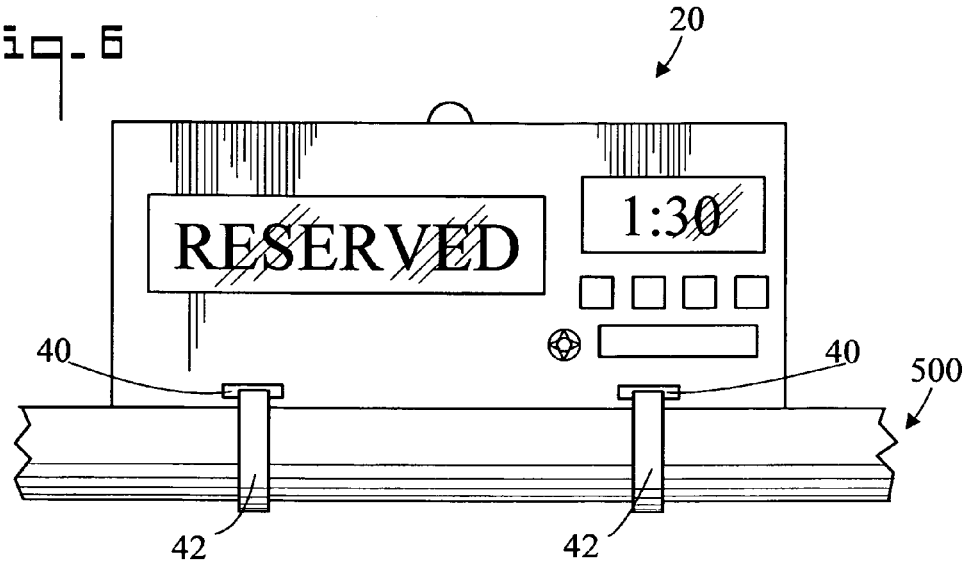
FIG. 6 is a fragmented front elevation view of the timer connected to the communal item.

FIG. 6 is a fragmented front elevation view of timer 20 connected to communal item 500. The connection can be effected by numerous connection means such as hook and loop fasteners, clips, straps, snap fit fasteners, magnets, ties, adhesives, and the like. In the shown embodiment, timer 20 includes two slots 40 each of which receives a connecting strap 42. Alternatively, timer 20 can simply be carried and placed on or near communal item 500 with positive mounting not required.

FIG. 7 is a front elevation view of timer 20 with service request indicator 32 in an extended position. In the shown embodiment, service request indicator 32 is a flag on a pole which pivots to the extended and retracted positions. Tab 34 is used to pivotally rotate service request indicator 32 to the extended (service requested) position.

Figure 8:
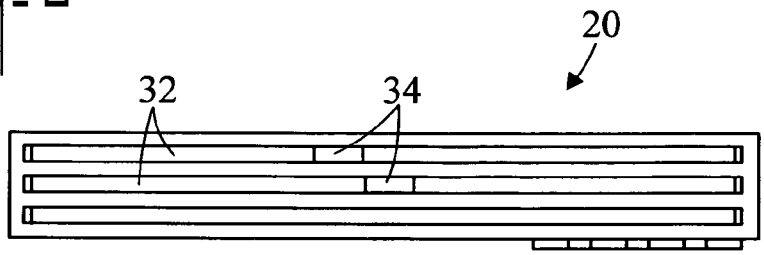
FIG. 8 is a top plan view of the timer with a plurality of service request indicators.

FIG. 8 is a top plan view of timer 20 which has a plurality of service request indicators 32 and associated tabs 34. Service request indicators 32 could be different colors to indicate which service is requested (e.g. drinks, food, etc).

Figure 9:
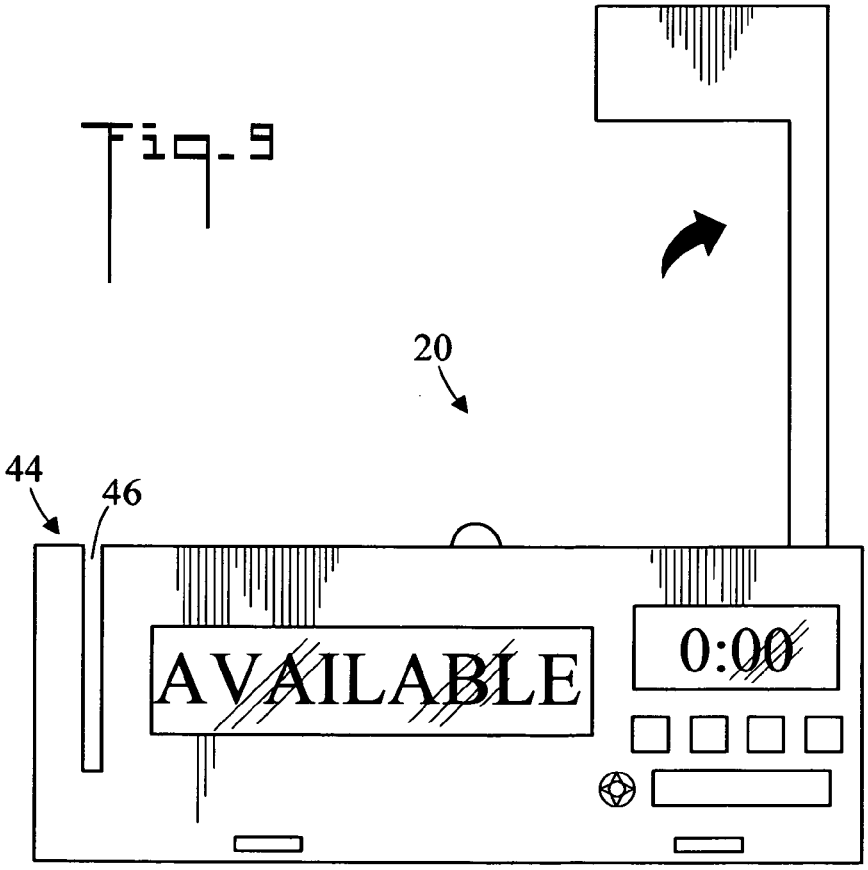
FIG. 9 is a front elevation view of the timer with an enabling transaction feature.

FIG. 9 is a front elevation view of the timer with an enabling transaction 44 feature (also refer to FIG. 10 and the associated discussion). In this embodiment an enabling transaction such as the swipe of a room card is required to operate timer 20. The room card is passed through a card-reader slot 46 in timer 20. Timer 20 reads the room card and, if valid, enables operation of timer 20 through timer control 24.

FIG. 10 is block diagram of timer 20. In the shown embodiment, timer 20 includes timing mechanism 22, timer control 24, remaining time indicator 25, communal item available indicator 28, control mechanism 30, display 36, enabling transaction 44, and power supply 50. In the diagram (and in FIG. 12) electrical connections are shown with a solid arrow and mechanical connections or actions are shown with a dashed arrow. The timing mechanism 22, timer control 24, remaining time indicator 25, and power supply 50 features of timer 20 comprise a digital timer which is well known in the art. Timing mechanism 22 is a microprocessor which receives a time set input from timer control 24. Control buttons 26 of timer control 24 permit a user to set a desired period of time during which communal item 500 will be reserved. The set time period is initially displayed on remaining time indicator 25 which then counts down as the set time period elapses. Timing mechanism 22 sends a signal to display 36 which causes a message such as RESERVED to appear. When the time period expires, timing mechanism 22 sends a signal to control mechanism 30 which in turn causes control mechanism 30 to activate available indicator 28.

In one embodiment control mechanism 30 is a latch which releases spring loaded available indicator 28 (a flag) allowing it to pivot to an extended position (refer to FIGS. 1, 2, and 4) thereby indicating that communal item 500 is available for another user. Also, timing mechanism 22 sends a signal to display 36 which causes a message such as AVAILABLE to appear.

In the shown embodiment, timer 20 also includes and enabling transaction 44 feature. The user is required to perform an enabling transaction before timing mechanism 22 will operate. For example enabling transaction 44 could be a card reader 46 (refer to FIG. 9), and before timing mechanism 22 can be set, the user's room card (key) must be passed through card reader 46. Alternatively, enabling transaction 44 could accommodate financial transactions, wherein credit cards, coins, or special tokens would be used to activate timing mechanism 22.

Power supply 50 is typically a battery, but could also be an electrical outlet or a solar power source.

Figure 11:
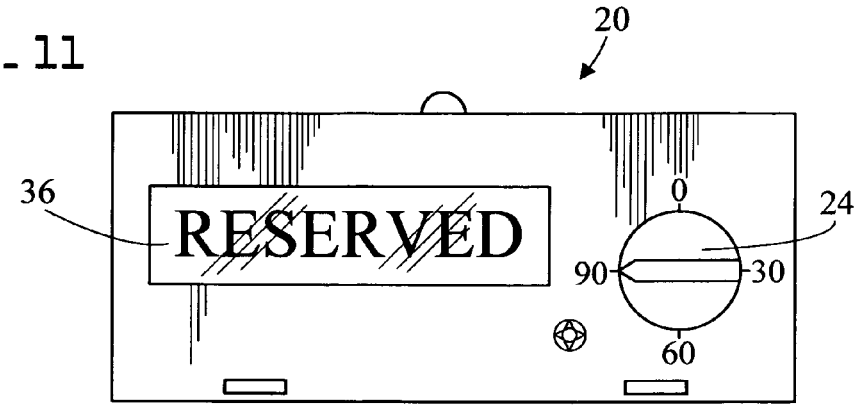
FIG. 11 is a front elevation view of a second embodiment of the timer.
Figure 12:
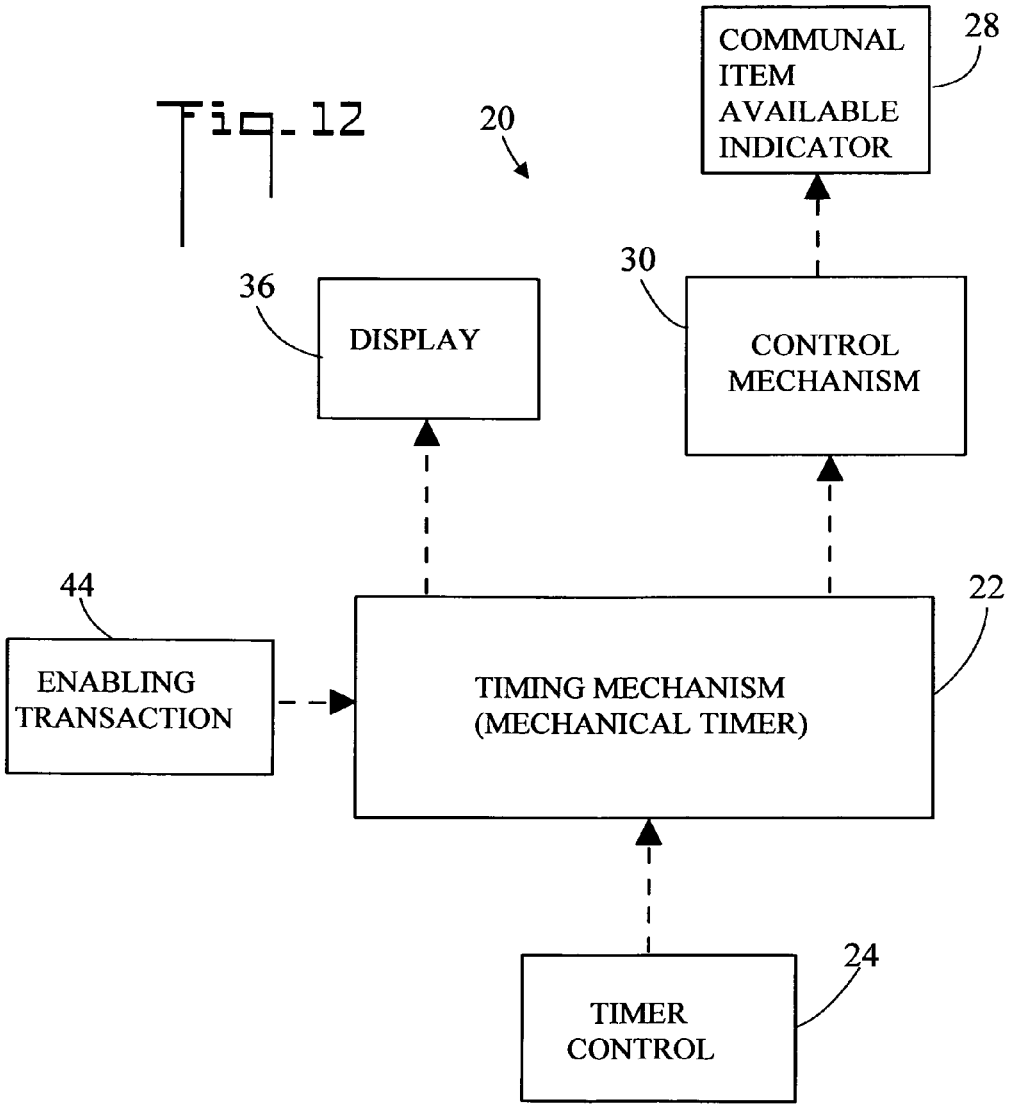
FIG. 12 is a block diagram of the second embodiment timer.

FIG. 11 is a front elevation view of a second embodiment of timer 20, and FIG. 12 is a block diagram of the second embodiment. In this embodiment timing mechanism 22 and timer control 24 comprise a mechanical timer which is well know in the art (U.S. Pat. Nos. 2,696,899 and 7,484,882 are examples of mechanical timer technology). Timer control 24 is a rotary knob which allows the user to set a desired time period (e.g. 90 minutes). Timing mechanism also causes display 36 to display a RESERVED message. Timing mechanism 22 then mechanically counts down time until the set time period expires. At expiration timing mechanism 22 sends a signal to control mechanism 30 which in turn causes available indicator 28 to move to the extended position indicating that communal item 500 is available for another user. Timing mechanism 22 also causes display 36 to display an AVAILABLE message. In this embodiment enabling transaction 44 could accept coins or tokens.

In another embodiment, timer 20 and communal item 500 are combined to form a reservation system for reserving occupancy of communal item 500.

In another aspect, timer 20 reserves occupancy of communal item 500 both when the user is actually using communal item 500, and when the user has temporarily stepped away from communal item 500. That is, occupancy remains reserved regardless of the physical presence of the user.

In addition to the previously mentioned examples, timer 20 can be used in a variety of other situations some of which are outlined below:

- Beach chairs, umbrellas & tables to prevent "chair hogging"
- Parks to reserve picnic tables, shelter houses etc
- Crowded restaurants where there is a wait for a table, this would limit/monitor the amount of time one party occupies a table
- To regulate the amount of time spent on gym equipment such as cardio machines in a busy or crowded gym when guests are waiting to use an available machine or piece of equipment
- To regulate time usage of a limited number of computers in a crowded computer lab
- To regulate the time spent by children playing in or on a toy or amusement park/fair attraction (eg: bounce house)

In terms of use, a method for a user to reserve occupancy of a communal item includes, (a) providing a communal item 500;

(b) providing a timer 20 which is connectable to communal item 500, timer 20 including:

- a timing mechanism 22 which is settable to run for a period of time;
- a timer control 24 which is used to set the period of time;
- a communal item available indicator 28 which is positionable to (1) a retracted position during the period of time, the retracted position indicating that the communal item 500 is reserved, and (2) to an extended position after the period of time has expired, the extended position indicating that the communal item is available;
- a control mechanism 30 which, when the period of time has expired, causes communal item available indicator 28 to move to the extended position;
- a service request indicator 32 which is postionable to (1) a retracted position, and (2) an extended position which indicates that a service is requested;

(c) connecting timer 20 to communal item 500;

(d) causing communal item available indicator 28 to be in the retracted position; It is noted that in one embodiment communal item available indicator 28 is manually placed in the retracted position by the user.

(e) the user setting timing mechanism 22 to run for a period of time;

(f) the user using communal item 500 during the period of time; and, (g) after the period of time expires, communal item available indicator 28 moving to the extended position thereby notifying other users that communal item 500 is available for use.

The method further including:

during step (f), the user leaving the vicinity of communal item 500 wherein occupancy is of communal item 500 remains reserved.

The method further including:

in step (b), timer 20 including a display 36 which is capable of displaying a first message during the period of time, and a second message after the period of time has expired;

during step (f), the first message being displayed; and, during step (g), the second message being displayed.

The method further including:

in step (b), the first message being a reserved message, and the second message being an available message.

The method further including:

during step (f), the user positioning service request indicator 32 to the extended position.

The method further including:

in step (b), timer control 24 including a reset control which interrupts said running of timing mechanism 22 and allows resetting of timing mechanism 22 to a lower remaining time, the reset control requiring a key to effect the resetting to a lower remaining time;

the key being possessed by a person other than the user who is authorized to perform the resetting; and, during step (f), before the period of time has expired, the authorized person using the reset control to reset timing mechanism 22 to a lower remaining time.

The method further including:

in step (b), timer control 22 including a reset control which interrupts the running of timing mechanism 22 and allows resetting of timing mechanism 22 to a higher remaining time, the reset control requiring a key to effect the resetting to a higher remaining time;

the key being possessed by a person other than the user who is authorized to perform the resetting; and, during step (f), before the period of time has expired, the authorized person using the reset control to reset the timing mechanism to a higher remaining time.

The method further including:

the performance of steps (a) through (g) educating the user and other users as to the proper procedure for reserving occupancy of communal item 500.

The possible embodiments of the timer and method of use described herein are exemplary and numerous modifications, combinations, variations, and rearrangements can be readily envisioned to achieve an equivalent result, all of which are intended to be embraced within the scope of the appended claims. Further, nothing in the above-provided discussions and drawings of the timer and method of use should be construed as limiting the invention to a particular embodiment or combination of embodiments. The scope of the invention is best defined by the appended claims.

We claim:

1. A timer for reserving occupancy of a communal item, comprising:

a timing mechanism which is settable to run for a period of time;

a timer control which is used to set said period of time;

a communal item available indicator which is positionable to (1) a retracted position during said period of time, and (2) to an extended position after said period of time has expired;

a control mechanism which, when said period of time has expired, causes said communal item available indicator to move to said extended position;

a service request indicator which is postionable to (1) a retracted position, and (2) an extended position which indicates that a service is requested; and, said timer connectable to the communal item.

2. The timer according to claim 1, further including:

a display capable of displaying a first message during said period of time, and a second message after said period of time has expired.

3. The timer according to claim 2, further including:

said first message being a reserved message, and said second message being an available message.

4. The timer according to claim 1, further including:

said communal item available indicator biased to said extended position; and, said control mechanism holding said communal item available indicator in said retracted position during said period of time, and releasing said communal item available indicator when said period of time has expired so that said communal item available indicator is urged to said extended position.

5. The timer according to claim 1, further including:

once said timing mechanism has begun to run, said timing mechanism not being resettable to a lower remaining time.

6. The timer according to claim 1, further including:

said timer control including a reset control which interrupts said running of said timing mechanism and allows resetting of said timing mechanism to a lower remaining time; and, said reset control requiring a key to effect said resetting to a lower remaining time.

7. The timer according to claim 1, further including once said timing mechanism has begun to run, said timing mechanism not being resettable to a higher remaining time.

8. The timer according to claim 1, further including:

said timer control including a reset control which interrupts said running of said timing mechanism and allows resetting of said timing mechanism to a higher remaining time; and, said reset control requiring a key to effect said resetting to a higher remaining time.

9. The timer according to claim 1, further including:

a plurality of said service request indicators.

10. The timer according to claim 1, further including:

a display capable of displaying a reserved message during said period of time, and an available message after said period of time has expired;

said communal item available indicator biased to said extended position;

said control mechanism holding said communal item available indicator in said retracted position during said period of time, and releasing said communal item available indicator when said time period has expired so that said communal item available indicator is urged to said extended position;

said timer control including a reset control which interrupts said running of said timing mechanism and allows resetting of said timing mechanism to a lower remaining time;

said reset control requiring a key to effect said resetting to a lower remaining time;

said timer control including a reset control which interrupts said running of said timing mechanism and allows resetting of said timing mechanism to a higher remaining time;

said reset control requiring a key to effect said resetting to a higher remaining time; and, a plurality of said service request indicators.

11. A reservation system for reserving occupancy of a communal item, comprising:

a communal item;

a timer connected to said communal item, said timer including:

a timing mechanism which is settable to run for a period of time;

a timer control which is used to set said period of time;

a communal item available indicator which is positionable to (1) a retracted position during said period of time, and (2) to an extended position after said period of time has expired;

a control mechanism which, when said period of time has expired, causes said communal item available indicator to move to said extended position; and, a service request indicator which is postionable to (1) a retracted position, and (2) an extended position which indicates that a service is requested.

12. The reservation system according to claim 11, further including:

a display capable of displaying a first message during said period of time, and a second message after said period of time has expired.

13. The reservation system according to claim 12, further including:

said first message being a reserved message, and said second message being an available message.

14. The reservation system according to 11, further including:

said communal item available indicator biased to said extended position; and, said control mechanism holding said communal item available indicator in said retracted position during said period of time, and releasing said communal item available indicator when said period of time has expired so that said communal item available indicator is urged to said extended position.

15. The reservation system according to claim 11, further including:

once said timing mechanism has begun to run, said timing mechanism not being resettable to a lower remaining time.

16. The reservation system according to claim 11, further including:

said timer control including a reset control which interrupts said running of said timing mechanism and allows resetting of said timing mechanism to a lower remaining time; and, said reset control requiring a key to effect said resetting to a lower remaining time.

17. The reservation system according to claim 11, further including once said timing mechanism has begun to run, said timing mechanism not being resettable to a higher remaining time.

18. The reservation system according to claim 11, further including:

said timer control including a reset control which interrupts said running of said timing mechanism and allows resetting of said timing mechanism to a higher remaining time; and, said reset control requiring a key to effect said resetting to a higher remaining time.

19. The reservation system according to claim 11, further including:

a plurality of said service request indicators.

20. The reservation system according to claim 11, further including:

a display capable of displaying a reserved message during said period of time, and an available message after said period of time has expired;

said communal item available indicator biased to said extended position;

said control mechanism holding said communal item available indicator in said retracted position during said period of time, and releasing said communal item available indicator when said time period has expired so that said communal item available indicator is urged to said extended position;

said timer control including a reset control which interrupts said running of said timing mechanism and allows resetting of said timing mechanism to a lower remaining time;

said reset control requiring a key to effect said resetting to a lower remaining time;

said timer control including a reset control which interrupts said running of said timing mechanism and allows resetting of said timing mechanism to a higher remaining time;

said reset control requiring a key to effect said resetting to a higher remaining time; and, a plurality of said service request indicators.

21. A method for a user to reserve occupancy of a communal item, comprising:

(a) providing a communal item;

(b) providing a timer which is connectable to said communal item, said timer including:

a timing mechanism which is settable to run for a period of time;

a timer control which is used to set said period of time;

a communal item available indicator which is positionable to (1) a retracted position during said period of time; said retracted position indicating that said communal item is reserved, and (2) to an extended position after said period of time has expired, said extended position indicating that said communal item is available;

a control mechanism which, when said period of time has expired, causes said communal item available indicator to move to said extended position;

a service request indicator which is postionable to (1) a retracted position, and (2) an extended position which indicates that a service is requested;

(c) connecting said timer to said communal item;

(d) causing said communal item available indicator to be in said retracted position;

(e) the user setting said timing mechanism to run for a period of time;

(f) the user using said communal item during said period of time; and, (g) after said period of time expires, said communal item available indicator moving to said extended position thereby notifying other users that said communal item is available for use.

22. The method of claim 21, further including:

during step (f), the user leaving the vicinity of said communal item wherein said occupancy is of said communal item remains reserved.

23. The method of claim 21, further including:

in step (b), said timer including a display which is capable of displaying a first message during said period of time, and a second message after said period of time has expired;

during step (f), said first message being displayed; and, during step (g), said second message being displayed.

24. The method of claim 23, further including:

in step (b), said first message being a reserved message, and said second message being an available message.

25. The method of claim 21, further including:

during step (f), the user positioning said service request indicator to said extended position.

26. The method of claim 21, further including:

in step (b), said timer control including a reset control which interrupts said running of said timing mechanism and allows resetting of said timing mechanism to a lower remaining time, said reset control requiring a key to effect said resetting to a lower remaining time;

said key being possessed by a person other than the user who is authorized to perform said resetting; and, during step (f), before said period of time has expired, the authorized person using said reset control to reset said timing mechanism to a lower remaining time.

27. The method of claim 21, further including:

in step (b), said timer control including a reset control which interrupts said running of said timing mechanism and allows resetting of said timing mechanism to a higher remaining time, said reset control requiring a key to effect said resetting to a higher remaining time;

said key being possessed by a person other than the user who is authorized to perform said resetting; and, during step (f), before said period of time has expired, the authorized person using said reset control to reset said timing mechanism to a higher remaining time.

28. The method of claim 21, further including:

said performance of steps (a) through (g) educating the user and other users as to the proper procedure for reserving occupancy of a communal item.

* * * * *